US011331704B2

(12) United States Patent
Lengauer et al.

(10) Patent No.: US 11,331,704 B2
(45) Date of Patent: May 17, 2022

(54) ROLLER FRAMEWORK HAVING A FRAMEWORK COOLER FOR COOLING A STEEL BAND

(71) Applicant: Primetals Technologies Austria GmbH, Linz (AT)

(72) Inventors: Thomas Lengauer, Weißkirchen a.d. Traun (AT); Bernd Linzer, Leombach (AT); Alois Seilinger, Linz (AT); Michael Zahedi, St. Marien (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 134 days.

(21) Appl. No.: 16/620,896

(22) PCT Filed: Jul. 19, 2018

(86) PCT No.: PCT/EP2018/069668
§ 371 (c)(1),
(2) Date: Dec. 10, 2019

(87) PCT Pub. No.: WO2019/020492
PCT Pub. Date: Jan. 31, 2019

(65) Prior Publication Data

US 2020/0156130 A1 May 21, 2020

(30) Foreign Application Priority Data

Jul. 24, 2017 (EP) ..... 17182794

(51) Int. Cl.
*B21B 45/02* (2006.01)
*B21B 1/26* (2006.01)
(Continued)

(52) U.S. Cl.
CPC ..... *B21B 45/0218* (2013.01); *B21B 45/0233* (2013.01); *B21B 1/26* (2013.01);
(Continued)

(58) Field of Classification Search
CPC . B21B 45/0251; B21B 1/26; B21B 2001/225; B21B 37/74; B21B 2027/103;
(Continued)

(56) References Cited

U.S. PATENT DOCUMENTS 3,151,197 A 9/1964 Schultz
3,856,281 A * 12/1974 Bertolotti ..... B21B 45/0233 134/64 R
(Continued)

FOREIGN PATENT DOCUMENTS

CN 1630564 A 6/2005
CN 101253009 A 8/2008
(Continued)

OTHER PUBLICATIONS

Chinese Office Action, dated Nov. 4, 2020, issued in corresponding Chinese Patent Application No. 201880049721.8. Total 7 pages.
(Continued)

*Primary Examiner* — Teresa M Ekiert
*Assistant Examiner* — Teresa A Guthrie
(74) *Attorney, Agent, or Firm* — Ostrolenk Faber LLP

(57) ABSTRACT

A framework cooler (20) for cooling a steel strip (50), installed in a roller framework (11), in place of the work rolls (5) and their associated installation pieces (5*a* and 5*b*). The framework cooler (20) is sized to be installed into the roller framework (11) through the operator-side roller stands (1) of the roller framework (11). The cooler (20) includes a lower (21*b*) and an upper water tank (21*a*), each having a connection (22) for a coolant, and includes a plurality of cooling nozzles (23), or cooling tubes (23*a*) arranged in the depth direction (T) of the framework cooler (20) or at least one cooling slot (24) extending in the depth direction (T). The bottom and top sides of the steel strip (50) may be cooled.

10 Claims, 11 Drawing Sheets

(51) Int. Cl.
*B21B 37/74* (2006.01)
*B21B 1/22* (2006.01)
*B21B 27/10* (2006.01)

(52) U.S. Cl.
CPC ..... *B21B 37/74* (2013.01); *B21B 45/0251* (2013.01); *B21B 2001/225* (2013.01); *B21B 2027/103* (2013.01); *B21B 2261/20* (2013.01)

(58) Field of Classification Search
CPC ..... B21B 2261/20; B21B 2013/003; B21B 31/08–14; B21B 45/02–0233; Y10T 29/49716; B23P 23/04; B23P 23/06
USPC ..... 72/201, 237–239
See application file for complete search history.

(56) References Cited

U.S. PATENT DOCUMENTS

| | | | | |
|---|---|---|---|---|
| 6,053,022 | A * | 4/2000 | Shore | B21B 35/02 72/235 |
| 10,040,107 | B2 | 8/2018 | Sano | |
| 10,384,248 | B2 | 8/2019 | Breuer | |
| 2011/0195200 | A1 | 8/2011 | Behrens | |
| 2012/0297849 | A1 | 11/2012 | Berchem | 72/201 |
| 2015/0336146 | A1* | 11/2015 | Charre | B21B 27/10 72/43 |
| 2017/0056944 | A1* | 3/2017 | Wang | B21B 45/0218 |

FOREIGN PATENT DOCUMENTS

| | | | | |
|---|---|---|---|---|
| CN | 101352728 | A | 1/2009 | |
| CN | 101829682 | A | 9/2010 | |
| CN | 102189127 | A | 9/2011 | |
| CN | 102655959 | A | 9/2012 | |
| CN | 102755999 | A | 10/2012 | |
| CN | 103934291 | A | 7/2014 | |
| CN | 105848797 | A | 8/2016 | |
| CN | 105960293 | A | 9/2016 | |
| DE | 1 954 859 | A1 | 6/1970 | |
| DE | 2 235 063 | A1 | 1/1973 | |
| DE | 37 04 599 | A1 | 8/1988 | |
| DE | 3704599 | A1 * | 8/1988 | B21B 45/0233 |
| EP | 0180254 | A1 | 5/1986 | |
| EP | 2516079 | B1 | 2/2015 | |
| JP | S62-61713 | A | 3/1987 | |
| JP | H03-294015 | A | 12/1991 | |
| SU | 889170 | A1 | 12/1981 | |
| SU | 1047970 | A1 | 10/1983 | |

OTHER PUBLICATIONS

International Search Report dated Oct. 5, 2018 in corresponding PCT International Application No. PCT/EP2018/069668.
Written Opinion dated Oct. 5, 2018 in corresponding PCT International Application No. PCT/EP2018/069668.
Extended European Search Report dated Jan. 16, 2018 in corresponding European Patent Application No. 17182794.2.
Office Action, dated Nov. 9, 2021, issued in corresponding Russian Patent Application No. 2020105861. Total 6 pages.

* cited by examiner

ROLLER FRAMEWORK HAVING A FRAMEWORK COOLER FOR COOLING A STEEL BAND

CROSS-REFERENCE TO RELATED APPLICATIONS

The present application is a 35 U.S.C. §§ 371 national phase conversion of PCT/EP2018/069668, filed Jul. 19, 2018, the contents of which are incorporated herein by reference which claims priority of European Patent Application No. 17182794.2, filed Jul. 24, 2017, the contents of which are incorporated by reference herein. The PCT International Application was published in the German language.

TECHNICAL FIELD

The present invention relates to the field of rolling mill technology, in particular to hot-rolling and cooling a metallic strip, for example a steel strip, or a sheet in a rolling train. The rolling train can be, for example, a finishing rolling train for the production of strip, or a hot-rolling train for the production of sheet.

The invention relates on the one hand to a roll stand having an operator-side roller housing and a drive-side roller housing, wherein no working rollers and no chocks for the working rollers are disposed in the roll stand.

The invention relates on the other hand to a method for installing a stand cooler for cooling a steel strip in a roll stand, as well as to a method for uninstalling a stand cooler of this type from a roll stand.

For reasons of clarity, a roll stand having uninstalled chocks and uninstalled working rollers is also referred to as a roll stand in this document. This nomenclature is self-evident to the person skilled in the art and enhances the clarity.

PRIOR ART AND BACKGROUND OF THE INVENTION

As is known, in hot-rolling the hot rolling stock is plastically deformed in a roll gap by so-called working rollers, which reduce the thickness of the rolling stock After hot-rolling, the rolled rolling stock is typically cooled in a cooling train and subsequently conveyed away from the rolling train, for example as a strip or sheet.

The material properties of a hot-rolled strip do not only depend on the chemical composition of the strip but also depend very heavily on the temporal sequence of the processing steps in the hot-rolling mill. In the case of a casting/rolling composite plant, for example an Arvedi ESP (Endless Strip Production) plant, the temporal sequence of continuous casting, pre-rolling, intermediate heating, finishing rolling, cooling, and coiling is of substantial importance, for example. When setting the microstructure, or the phase fractions, respectively, of the rolled strip (the hot-rolled strip after finishing rolling is referred to as the finished strip), the temporal interval between the last rolling pass in a roll stand of the rolling train and the start of the cooling of the strip is also significant. This temporal duration should be as short as possible in many cases.

Hot-rolling mills have a fixed number of roll stands so that it is not possible by virtue of the high technical complexity of the machine for one or a plurality of roll stands of the rolling mill to be removed in the production of thick strips, and for removed roll stands to be added again in the production of thin strips. A rolling mill in general therefore has to be suitable for the production of thick strips as well as for the production of thin strips.

It is known that thick strips in a rolling mill are transported more slowly and the thickness of thick strips is reduced to a lesser extent than of thin strips. For example, this often leads to a thick strip being rolled to its final thickness already before passing the last roll stand, for example in the second roll stand, whereas a thin strip in the same rolling mill is rolled to its final thickness only in the last roll stand, for example the fifth roll stand. In the first-mentioned case, the roll stands 3, 4, and 5 are thus opened up such that the thick strip runs through the roll stands without being rolled therein. However, on account of the relatively slow transportation speed of thick strips and the fact that the last forming of the thick strip already takes place in one of the first roll stands, this causes a relatively long temporal duration until the finished strip reaches the cooling section following the last roll stand and therein is cooled by a specific intensity. This long temporal duration can lead to thick strips no longer being able to achieve specific material properties. On account of this, the product mix of the rolling mill is restricted.

This problem is further exacerbated in the continuous operation of casting/rolling composite plants since the transportation speed of the strip and the strip thickness are indirectly proportional. On account of the continuous operation the intermediate strip or finished strip cannot be accelerated on the roller table since the strip is coupled to the continuous casting plant. This leads to the transportation speed of a thick strip in an ESP plant potentially being in the range of 0.5 m/s or less, and of thus being substantially slower than in the case of other hot-rolling mills that are not operated in a continuous manner and can accelerate the rolling stock before, when, or after running through the rolling train, respectively.

However, the underlying problem cannot be satisfactorily solved even in the case of discontinuous operation (for example in the batch operation or the semi-continuous operation) of a hot-rolling mill, since variation in the strip speed is at all times also associated with variation in the temperature at the last rolling pass in the finishing rolling train. Moreover, cancellation of the endless coupling between apparatuses of a hot-rolling mill leads to many well-known problems, for example, the threading of the strip in and out of the roll stands and the cooling section, the shocks on account of the strip head and the strip base, the dissimilar temperatures of the strip head and the strip base, etc. This potential solution is thus also either completely excluded or is at least not implementable in a satisfactory manner.

A cooling assembly which can be disposed ahead of or behind a roll stand is known from US 2017/0 056 944 A1. This cooling assembly has a design embodiment such as, in terms of the basic approach, is known in conventional cooling sections. However, said cooling assembly by a few meters is shorter than conventional cooling sections.

An intermediate stand cooling for cooling a steel strip after a roll stand is known from DE 37 04 599 A1. The intermediate stand cooling comprises a lower and an upper water tank, wherein the water tanks in each case have one connector for a coolant, and a plurality of cooling nozzles or cooling pipes that are disposed in the depth direction of the stand cooler. The water tanks by way of the connectors can be supplied with coolant. This enables the lower side and the upper side of the steel strip to be cooled by cooling nozzles or cooling pipes of the water tanks.

Intermediate stand cooling is likewise known from DE 22 35 063 A1. Intermediate stand cooling comprises a lower and an upper water tank, wherein the water tanks have in each case one connector for a coolant and one cooling slot that extends in the depth direction. The water tanks can be supplied with coolant by the connectors. As a result, the lower side and the upper side of the steel strip can be cooled by way of the cooling slots of the water tanks.

In the case of thick strips, it cannot be derived from the prior art how the problem of the long temporal duration between the last rolling pass and the beginning of the cooling in hot-rolling mills, in particular in the case of continuously operated casting/rolling composite plants, can be overcome.

SUMMARY OF THE INVENTION

The object of the invention lies in modifying the current prior art by an innovative solution for a hot-rolling mill, in particular a casting/rolling composite plant, and here very particularly for a continuously operated casting/rolling composite plant. The temporal period between the last rolling pass when hot-rolling and the beginning of the cooling of the strip can be reduced without one or a plurality of roll stands having to be removed from the hot-rolling mill before the production of thick strips, or removed roll stands having to be re-installed before the subsequent production of thin strips, respectively. The product mix of the hot-rolling mill is to be expanded on account of the solution, and a wide range of high-quality steel strip is to be able to be produced.

This object of the device is achieved by a rolling mill having the features disclosed herein.

In concrete terms, the object is achieved by a roll stand having an operator-side roller housing and a drive-side roller housing, with the following features:

No working rollers and no chocks for the working rollers are disposed in the roll stand, but the roll stand instead has a stand cooler for cooling a steel strip.

The stand cooler is dimensioned so that said stand cooler can be installed in the roll stand through the operator-side roller housing of the roll stand;

The stand cooler comprises a first or lower coolant tank, in particular a water tank, and a second or upper coolant tank, in particularly a water tank, wherein the lower coolant or water tank and the upper coolant or water tank in each case have one connector for a coolant, and a plurality of cooling nozzles or cooling pipes that are disposed in the depth direction of the stand cooler, or has at least one cooling slot that runs in the depth direction of the stand cooler, such that the lower and the upper water tanks can be supplied with coolant by way of their respective connectors, the lower side of the steel strip can be cooled by the cooling nozzles, or cooling pipes, or cooling slot of the lower water tank. The upper side of the steel strip can be cooled by the cooling nozzles, or cooling pipes or cooling slot of the upper water tank.

The term "stand cooler" refers to a cooling installation which can cool a steel strip by an adjustable intensity and be installed in a roll stand, instead of chocks and working rollers. The term "stand cooler" explicitly does not refer to a cooling installation which cools the rollers of a roll stand.

The stand cooler may also have a combination of a plurality of cooling nozzles, or cooling pipes, respectively, and one or a plurality of cooling slots.

The stand cooler may be installed in the roll stand instead of chocks and upper and lower working rollers such that the roll stand of the stand cooler may cool the upper and the lower sides of a steel strip by a given intensity. Cooling here means such cooling which is comparable to the cooling in a cooling section disposed downstream of the rolling train.

It is known for an intermediate stand cooling to be used between the roll stands of a hot-rolling train so as to dissipate the heat created in the material during the deformation and to keep the strip temperature within permissible limits. This cooling is usually not dimensioned for achieving cooling of the strip in the context of this invention. In order for the cooled region to be expanded, a combination of a stand cooler with an intermediate cooling (which cools the strip only between the roll stands) is possible and advantageous for specific requirements.

For cooling, the stand cooler has an upper (second) and a lower (first) water tank which each have at least one connector for a coolant and either a plurality of cooling nozzles or cooling pipes that are disposed in the depth direction of the stand cooler, or at least one cooling slot that runs in the depth direction of the stand cooler.

The lower and the upper water tanks are supplied with coolant by the respective connector or connectors, respectively. The coolant is typically water, but may be any other coolant that may be sprayed on a strip for cooling the strip. The cooling of the lower and the upper side of the steel strip is by cooling nozzles or cooling pipes, or one or a plurality of cooling slots, respectively.

For installing and uninstalling the stand cooler in a simple manner, it is advantageous for the stand cooler to have at least two guide faces. The guide faces are connected to the lower or the upper water tank such that the stand cooler can be incorporated, for example by push-fitting into the roll stand in the width direction of the roll stand, or the steel strip, respectively, and the stand cooler in the installed state preferably bears on the guide faces.

On at least two guide faces which are connected to the upper and/or the lower water tank, the stand cooler may be incorporated into the roll stand in a simple manner, for example on rails, in the width direction of the roll stand. After having been moved in, the roll stand can remain on the rails, or be supported by the bending block, for example. The stand cooler in the installed state preferably bears on the guide faces.

Because the chocks and the upper and the lower working roller are replaced by the stand cooler, the temporal period between the finishing rolling, that is the last rolling pass in the hot-rolling train, and the beginning of the strip cooling can be drastically shortened. For example, even thick hot strips can reach the required metallurgical properties, for example, microstructure and be produced with high quality. Moreover, the section between the last rolling roll stand and the cooling section is already used for cooling.

When the stand cooler is primarily installed or uninstalled, respectively, during an interruption in the rolling operation, for example when changing the working rollers of other roll stands, it is advantageous for the stand cooler to be embodied in one piece, wherein the lower and the upper water tanks are preferably connected to one another by uprights. The stand cooler in this embodiment can be installed and uninstalled as a unit.

When the stand cooler is to be installed or uninstalled, respectively, and also during the rolling operation, it is advantageous for the stand cooler to be embodied in at least two pieces, wherein the lower and the upper water tank have in each case two guide faces. That enables the upper part of the stand cooler to have the upper water tank to be installed in the roller housing independently of the lower part of the stand cooler having the lower water tank so installed. This facilitates uninterrupted rolling operation.

As an alternative to the embodiment being in two pieces, an embodiment in one piece would also be possible, for example having a "C"-shaped stand cooler.

In the two-piece embodiment of the stand cooler, the lower water tank may be incorporated into the roll stand on exchangeable rails, for example, and may subsequently remain on the latter, or be raised or lowered by the latter, respectively. During operation, the upper water tank may be supported on the bending blocks and may be raised or lowered by the blocks. The gap between the exit openings of the water tanks and the steel strip can be set during the operation.

Simple guiding of the stand cooler is guaranteed when the lower water tank and/or the upper water tank each have two lateral support lugs, wherein each of the two support lugs has one guide face.

Since it is often necessary for the peripheral regions and the central region of the steel strip, when viewed in the width direction of the steel strip, to be cooled to dissimilar extents, it is advantageous for the lower water tank and the upper water tank to have at least two connectors. Therefore, the cooling nozzles assigned to the peripheral regions can be supplied at a lower pressure than the cooling nozzles assigned to the central region, for example.

The roll stand most typically has at least supporting rollers. In this case, the stand cooler in the state installed in the roll stand is disposed between the supporting rollers of the roll stand.

Working rollers and chocks for the working rollers are present in the normal operation of any roll stand without the stand cooler. The stand cooler of the present invention is installed in the roll stand as an alternative to the working rollers and the chocks for the working rollers. The roll stand therefore preferably additionally has the mentioned working rollers and chocks for the working rollers. The working rollers and the chocks for the working rollers herein are dimensioned, as also in the prior art, so that after the stand cooler has been uninstalled from the roll stand, the working rollers and chocks can be installed in the roll stand through the operator-side roller housing of the roll stand.

The method of the invention relating to the installation of a stand cooler for cooling a steel strip in a roll stand of a rolling train is achieved by the following method steps:

- removing chocks and an upper and a lower working roller from the roll stand;
- installing the stand cooler in the roll stand, wherein the stand cooler in the width direction of the roll stand or of the steel strip, respectively is incorporated horizontally through an operator-side roller housing; and
- connecting the connectors of the upper and the lower water tanks to a coolant supply such that the upper and the lower sides of the steel strip can be cooled by a coolant from the cooling nozzles, or the cooling pipes or the cooling slot of the lower water tank and of the upper water tank.

The connecting of the connectors can take place, for example, by flange connections, or manually activated lever arm couplings having hose connections, or else by automatic coupling when pushing in the stand cooler.

For a discontinuously operated rolling mill, it is expedient for the installation of the stand cooler to be performed during an interruption in the operation of the rolling train.

In particular, in the case of continuously operated casting/rolling composite plants, for example of the Arvedi ESP type, it is advantageous for the installation of the stand cooler to take place during ongoing operation of the rolling train, in particular of a finishing rolling train.

According to one embodiment, one connector is supplied by a coolant at a pressure of 2 to 5 bar.

According to one further embodiment, one connector is supplied by a coolant at a pressure of 0.1 to 0.8 bar.

During operation of a stand cooler, it is advantageous for the connector or the connectors, respectively, of the lower water tank to be supplied at a higher pressure than the connector or the connectors, respectively, of the upper water tank. This can be achieved with separate pressure regulators for the upper and the lower connector. Alternatively, this can also be achieved by flow regulators operated such that the flow quantity to the lower water tank is higher than to the upper water tank (for example, 60% of the total water quantity is supplied to the lower water tank, and 40% is supplied to the upper water tank).

The aforementioned pressure ranges are not mutually exclusive, since the peripheral region of the steel strip can be cooled by a first connector having a coolant at a pressure of 0.1 to 0.8 bar, whereas the central region can be cooled by a second connector having a coolant at a pressure of 2 to 5 bar, for example.

The production of steel strips is advantageously, performed wherein a first steel strip is first rolled in at least two roll stands of a hot-rolling train. The first steel strip is subsequently cooled in a cooling section. The cooled first steel strip, for example as a slab or a coil, thereafter is conveyed away. Thereafter a stand cooler, as described above is installed in a roll stand of the rolling train. After the stand cooler has been installed in the roll stand, and a second steel strip is rolled in at least one roll stand of the rolling train, the second steel strip is cooled in at least one roll stand of the rolling train by the stand cooler, the cooled second steel strip is cooled in the cooling section, and the cooled second steel strip is conveyed away.

Another method relating to uninstalling a stand cooler from a roll stand includes the following method steps:

- separating the connectors of the upper and the lower water tanks from a coolant supply;
- uninstalling the stand cooler from the roll stand, wherein the stand cooler in the width direction of the roll stand is extracted (e.g. pulled out) horizontally from an operator-side roller housing; and
- installing chocks and an upper and a lower working roller in the roll stand.

Separating the connectors can again be performed by flange connections, or manually activated lever arm couplings having a hose connection, or by automatic coupling when pushing out the stand cooler, for example.

Depending on the type of plant of the rolling mill, or according to the operating mode thereof, continuous or discontinuous, uninstalling of the stand cooler can take place during the ongoing operation or during an interruption in the operation of a rolling train.

It is advantageous for the cooling output of the stand cooler to be set in a model-controlled manner as a function of the material, in particular the chemical composition, the rolling parameters, thickness and speed of the steel strip, as well as the steel quality to be achieved. A cooling model as a function of the aforementioned values delivers in-line, that is during the ongoing operation of the hot-rolling train, in each case a cooling water quantity, and optionally also a width-dependent cooling water distribution for the upper and the lower side of the steel strip. The pressure and/or the flow quantity of the cooling medium through the stand cooler are set in an open-loop controlled or closed-loop controlled manner, respectively, such that upon running the steel strip through the roll stand having the installed stand coolers, cooling in the cooling section achieves the desired properties in the best possible manner.

BRIEF DESCRIPTION OF THE DRAWINGS

Further advantages and features of the present invention are derived from the description of non-limiting exemplary embodiments. In the schematically illustrated figures hereunder:

FIGS. 1A and 1B show two views of a roll stand having installed chocks and working rollers as in the prior art, wherein FIG. 1A is a lateral view and FIG. 1B is a schematic sectional illustration of the roll stand;

FIG. 2 shows two views of chocks and working rollers as per the prior art, wherein

DESCRIPTION OF THE EMBODIMENTS

Figure 1A:
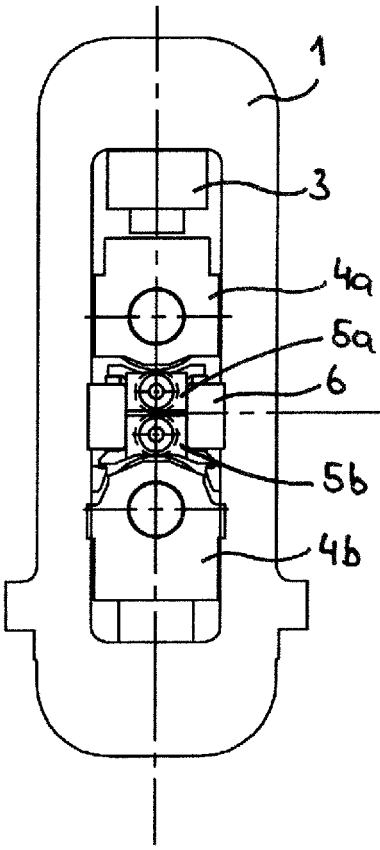
FIG. 1A (PRIOR ART)
Figure 1B:
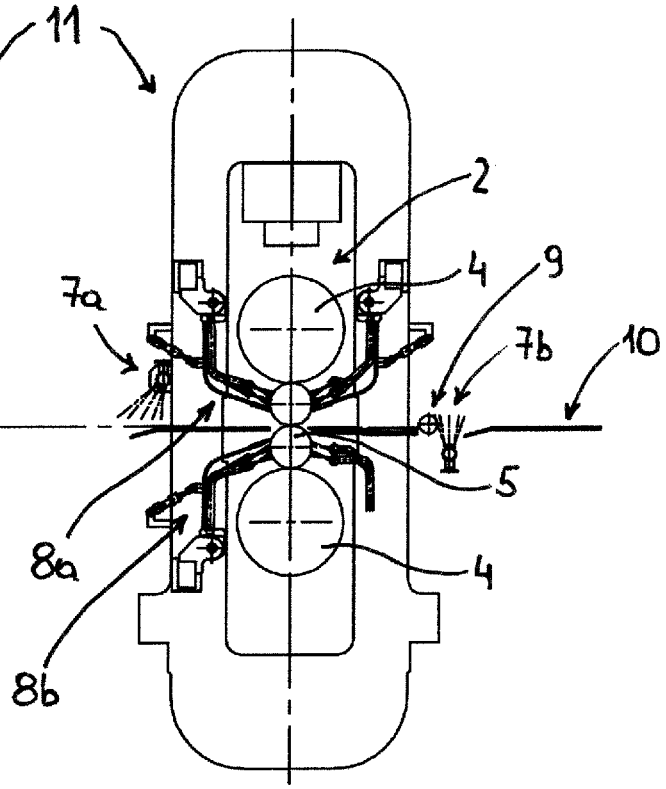
FIG. 1B (PRIOR ART)

FIG. 1A shows a lateral view of a prior art roll stand 11 having installed chocks 4*a*, 4*b*, respectively for an upper and a lower supporting roller 4 and installed chocks 5*a*, 5*b* for an upper and a lower working roller 5. FIG. 1B shows the roll stand 11 in a schematic sectional illustration without any chocks 4*a*, 4*b*, 5*a*, 5*b*. A hot strip (not illustrated), here a steel strip, in the roll stand 11 is rolled by the working rollers 5, wherein the working rollers 5 are supported on the supporting rollers 4 lying therebehind. A bending block 6 can flex the working rollers 5 and thus readjust the profile, or the planarity, respectively, of the rolled hot strip. The chocks 4*a*, 4*b*, 5*a*, 5*b* of the so-called AGC (short for Automatic Gap Control) cylinders 3 and the bending block 6 are installed in the two housing windows 2 of the roller housings 1. Only the operator-side roller housing 1 can be seen in FIG. 1. The drive-side roller housing is obscured by the operator-side roller housing 1. The drive-side roller housing 1 can be seen only in FIG. 11, but is not provided with a reference sign there.

The hot strip is guided on a rolling table 10 and is moved to the working rollers 5. To limit the temperature of the working rollers 5, at least one upper cooling head 8*a* (here, two are illustrated) and at least one lower cooling head 8*b* (here, two) of the working roller cooling are provided ahead, or upstream of and behind or downstream of the working rollers 5. Moreover, an upper cooling head of the intermediate stand cooling 7*a* is installed ahead, or upstream of the roll stand 11, and a lower cooling head of the intermediate stand cooling 7*b* is installed behind, or downstream of the roll stand 11. Of course, one upper and one lower cooling head of the intermediate stand cooling 7*a*, 7*b* can in each case also be disposed ahead of and behind the roll stand 11.

A pivotable loop lifter roll 9 can set the tension in the hot strip. The temperature of the hot strip before and after rolling can thus be modified. Since roll stands 11 having so-called stand chocks are known, a more detailed description of the prior art is dispensed with.

Figure 2A:
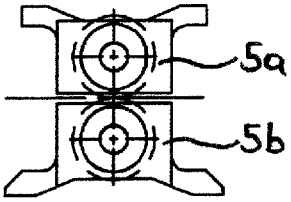
FIG. 2A (PRIOR ART)
FIG. 2A is a lateral view thereof and FIG. 2B is a front view thereof.
Figure 2B:
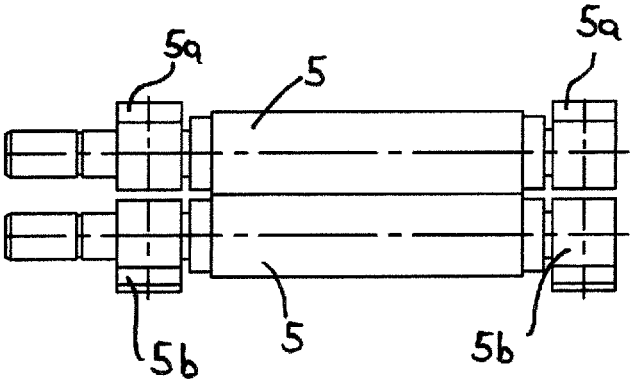
FIG. 2B (PRIOR ART)

A chock 5*a* having an upper working roller 5 and a chock 5*b* having a lower working roller 5 are illustrated in a lateral view in FIG. 2A and in a front view in FIG. 2B. The working rollers 5 are thus mounted so as to be displaceable in the roll stand 11 by the respective chocks 5*a*, 5*b*.

Figure 3:
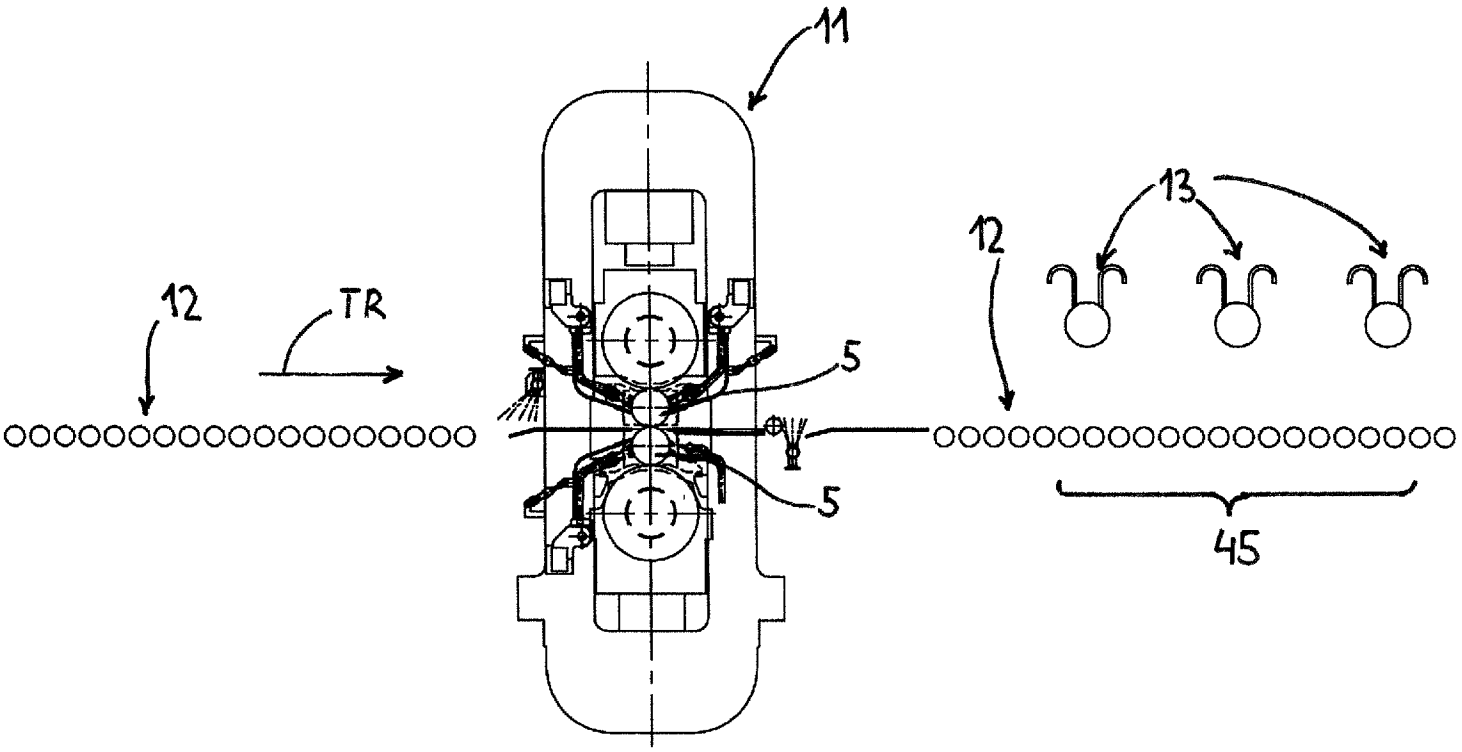
FIG. 3 (PRIOR ART)
FIG. 3 shows a lateral view of a roll stand ahead of a cooling section as per the prior art.

FIG. 3 shows the roll stand 11 of FIG. 1 in a rolling mill. A steel strip (not illustrated) extending on an upstream roller table 12 is fed in a transportation direction TR to the roll stand 11 and is there rolled in the roll gap between the two working rollers 5. After hot-rolling, the rolled strip on a subsequent downstream roller table 12 is in turn fed to a cooling section 45 having a plurality of cooling manifolds 13, where the strip is cooled by an adjustable intensity from the manifolds.

Figure 4:
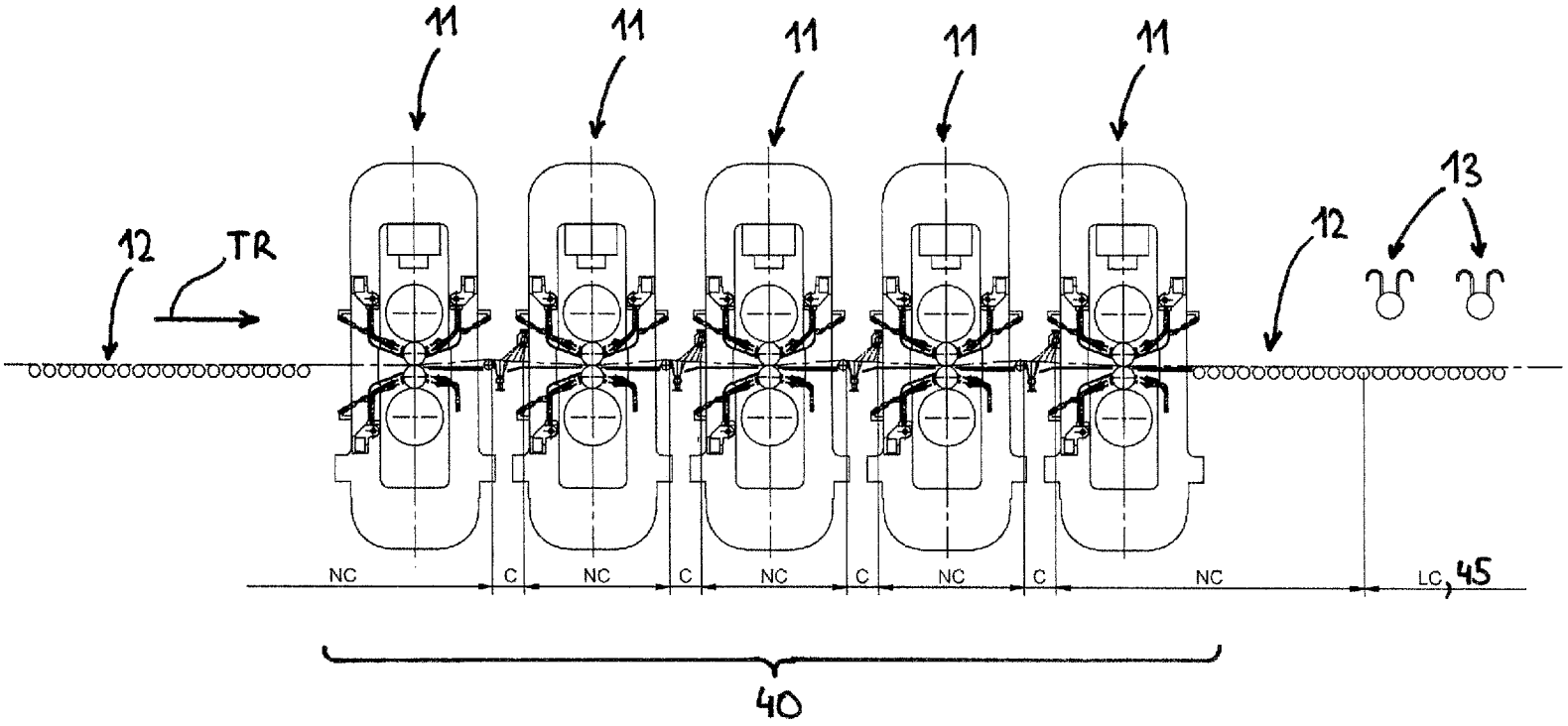
FIG. 4 (PRIOR ART)
FIG. 4 shows a lateral view of a finishing rolling train having five roll stands ahead of a cooling section as per the prior art.

FIG. 4 shows a potential situation when rolling a thick hot strip in a rolling train 40. The train 40 is configured as a finishing rolling train, having five roll stands 11. Since a thick hot strip is being rolled, the last rolling pass takes place in the third (that is to say the central) roll stand 11. The thickness of the hot strip herein illustrated is reduced from 45 mm to 20 mm, for example in the first three roll stands. After its having been rolled, the rolled finished strip exits the central roll stand 11 at a speed of 0.4 m/s, for example. The finished strip in the regions identified by C, between successive roll stands, may be cooled by the upper and the lower cooling heads of the intermediate stand cooling 7*a*, 7*b*. The finished strip cannot be cooled in the roll stand 11 per se. The non-cooled regions of the strip are identified by NC. Since the horizontal spacing between the stand centerline of the third roll stand 11 and the beginning of the cooling section 45 having the cooling manifolds 13 (In an example of two downstream roll stands 11 that are not used for rolling the strip 50 and of typical spacings between the roll stands 11) is approx. 20 m, the rolled hot strip according to the example above requires 50 s to reach the cooling section 45. This time is already excessively long for specific types of steel such that that steel strip can no longer achieve desired microstructure and phase properties, respectively. The intermediate stand cooling (marked by C in FIG. 4) having the upper and lower cooling heads 7*a*, 7*b* (see FIG. 1) makes no difference herein since the cooling output is insufficient and the rolled hot strip is largely not cooled on its way to the cooling section 45.

Figure 5:
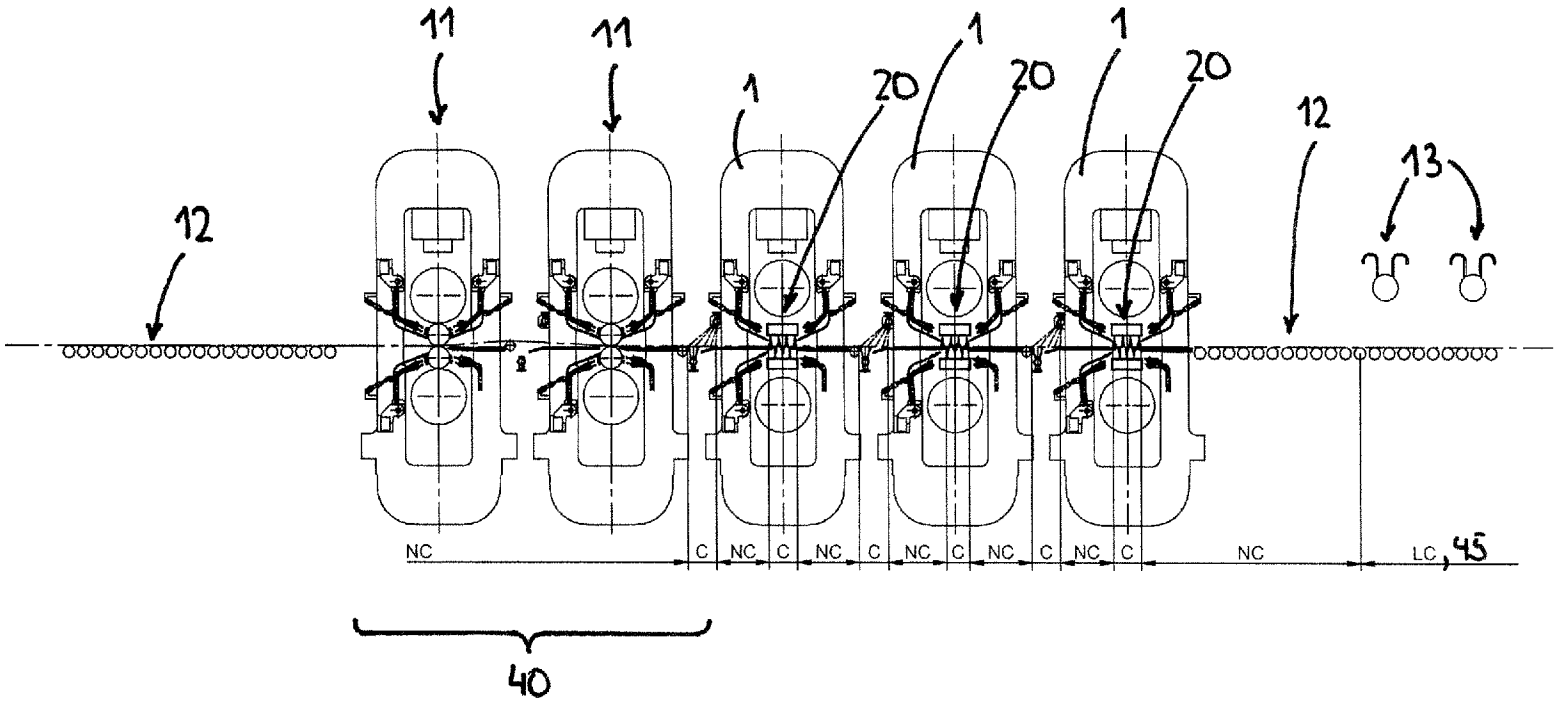
FIG. 5 shows a lateral view of a finishing rolling train having five roll stands, wherein one stand cooler according to the invention is installed in each of the last three roll stands.

FIG. 5 shows the situation when hot-rolling a thick steel strip in a rolling train 40, configured as a finishing rolling train having originally five roll stands 11. The chocks 5*a*, 5*b* and the working rollers 5 (see FIG. 1) are removed from the last three roll stands (see FIG. 4). Instead, one stand cooler 20, with details pertaining thereto in FIGS. 6 to 11), is in each case installed in each roller housing 1. The last rolling pass takes place in the second roll stand 11 from the left. The finished strip is in each case intensively cooled by one stand cooler 20 in the three subsequent roller housing 1. Because the steel strip has been cooled by the stand coolers 20, the finished strip is already cooled as from the central roller housing 1. This makes it possible to generate thick strips of specific steel grades (demanding tube grades, for example), which could not be produced without use of a stand cooler 20.

Figure 6A:
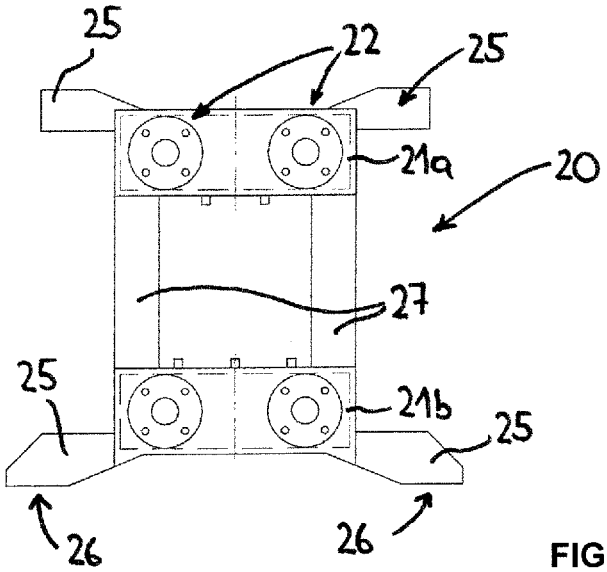
FIG. 6A shows an end view of a stand cooler and FIG. 6B shows a sectional view thereof.
Figure 6B:
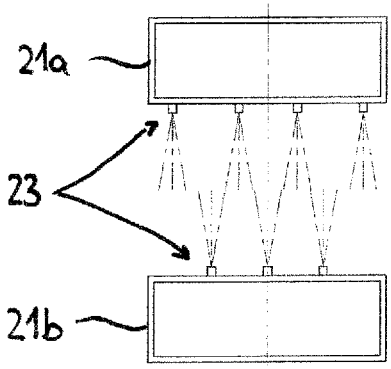

Two views of a stand cooler 20 are shown in FIGS. 6A and 6B, including a lateral view in FIG. 6A and a sectional illustration in FIG. 6B. The stand cooler 20 has an upper water tank 21*a* and a lower water tank 21*b*. The lower side of the upper water tank 21*a* and the upper side of the lower water tank 21*b* are populated by cooling nozzles 23 such that a hot strip (not illustrated here) may be cooled in the width direction B transversely to the feed direction. To further increase the cooling output, seven cooling nozzles are in each case disposed one behind another in the transportation direction (see FIG. 6B). The water tanks 21*a*, 21*b* have lateral support lugs 25, wherein the support lugs 25 of the lower water tank 21*b* have in each case one guide face 26. The stand cooler 20 can be moved in the width direction B of the hot strip into a roll stand (not illustrated here) on the guide faces 26. The stand cooler 20 illustrated as embodied in one piece, wherein the upper and the lower water tank 21*a*, 21*b* are connected to one another by uprights 27. The cooling nozzles 23 are supplied with coolant through four connectors 22, wherein two connectors 22 supply the upper and the lower water tanks 21*a*, 21*b*.

Figure 7:
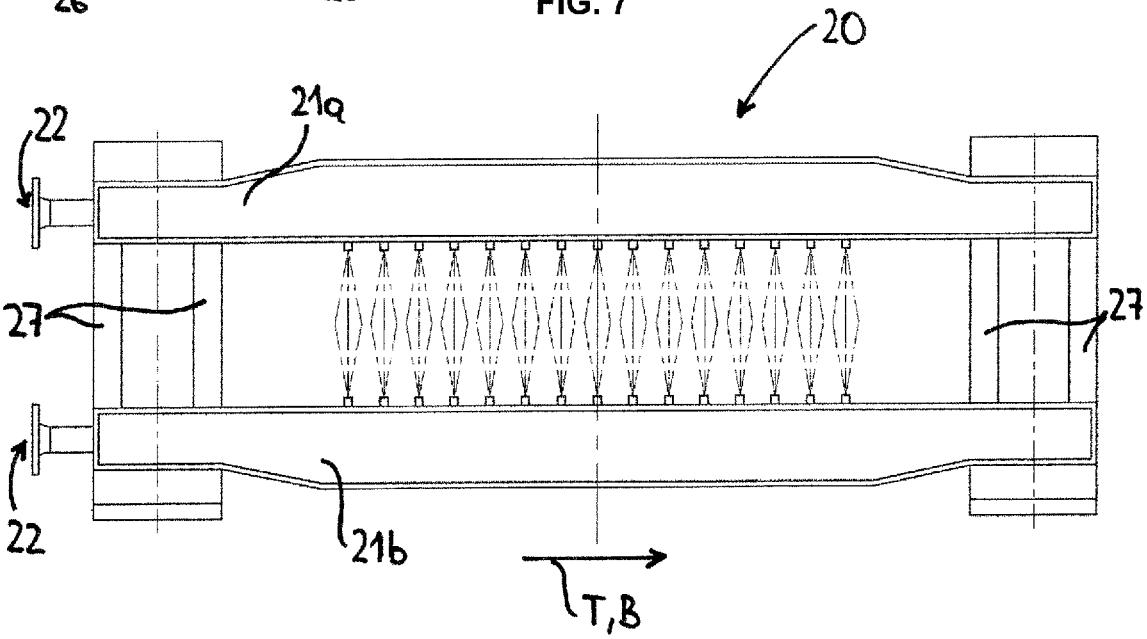
FIG. 7 shows a further view of the stand cooler from FIGS. 6A and 6B.

A front view of the stand cooler of FIGS. 6A and 6B is additionally illustrated in FIG. 7. The cooling nozzles 23 are typically supplied with coolant at a positive pressure of 2 to 5 bar. The cooling intensity is a function of the pressure and is adjustable by the positive pressure of the cooling medium.

Figure 8A:
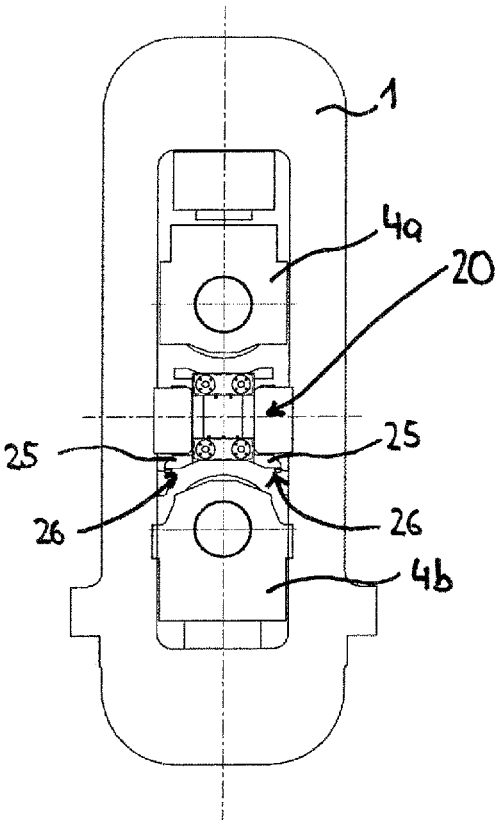
FIG. 8 shows two views of a roll stand having an installed stand cooler, with FIG. 8A including chocks and FIG. 8B showing the roll stand with the chocks removed.
Figure 8B:
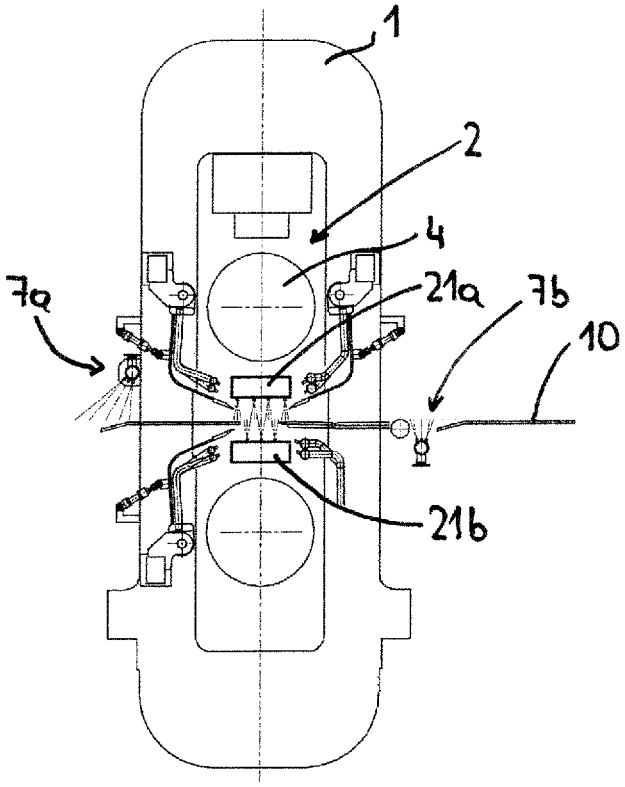

A roller housing 1 having a stand cooler 20 is illustrated in a lateral view in FIG. 8A and in a sectional illustration in FIG. 8B. The stand cooler 20 from FIGS. 6A, 6B and 7 in the installed state bears, and can be installed and uninstalled, on the two guide faces 26 of the lower support lugs 25, on guide rails in the roller housing 1, or on the counter guides of the chock 4*b* of the lower supporting roller. As can be seen, the stand cooler 20 is disposed between the supporting rollers 4, thus in line with the supporting rollers 4.

Figure 9A:
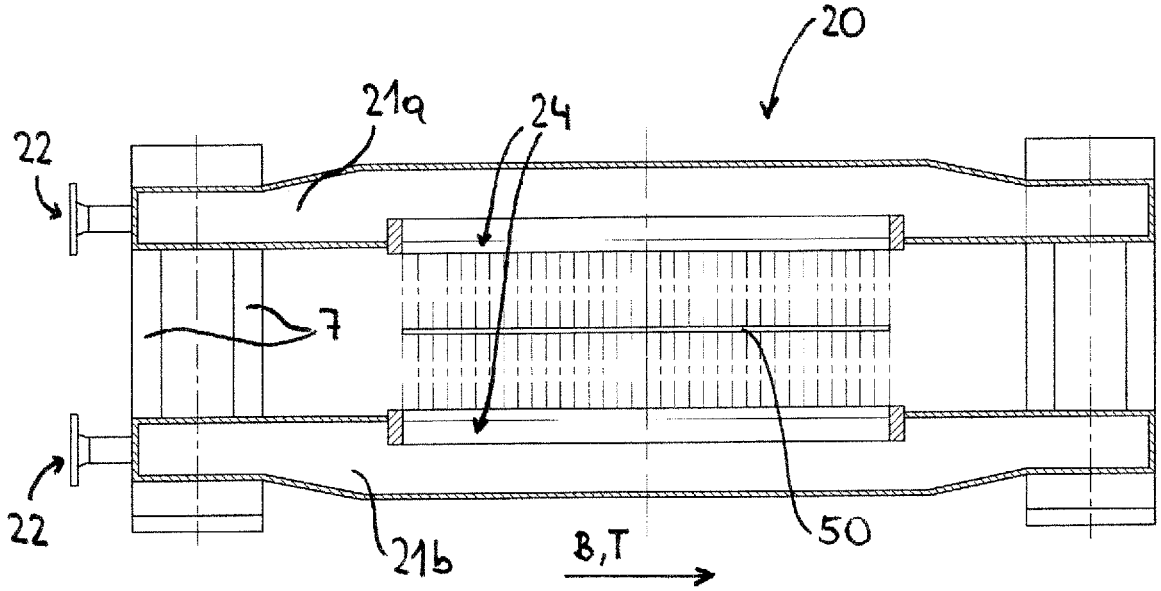
FIG. 9A shows a plan view of a stand cooler having a cooling slot.
Figure 9B:
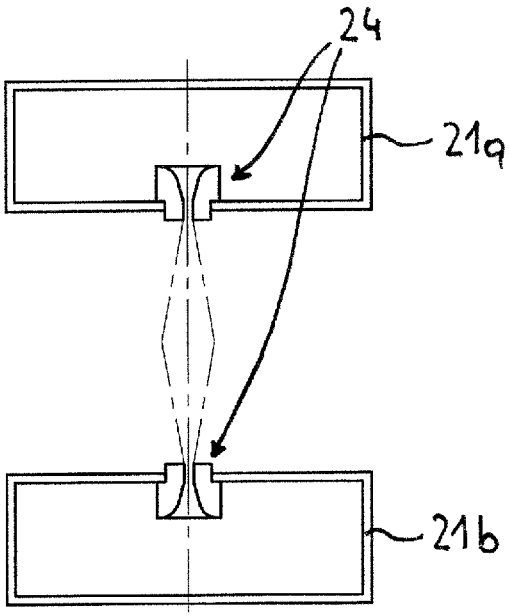
FIG. 9B shows a sectional view of the stand cooler.

FIGS. 9*a* and 9*b* show a stand cooler 20 which, as an alternative to the cooler shown in FIGS. 6A, 6B and 7, has cooling slots 24 instead of cooling nozzles. Since the steel strip 50 in the width direction B thereof, or in the depth direction T of the stand cooler 20, respectively, is not cooled to dissimilar extents it is sufficient for the upper and the lower water tank 21*a*, 21*b* to have in each case only one connector 22. The uprights 7 and the support lugs 25 are embodied as in FIGS. 6A, 6B and 7.

Figure 10:
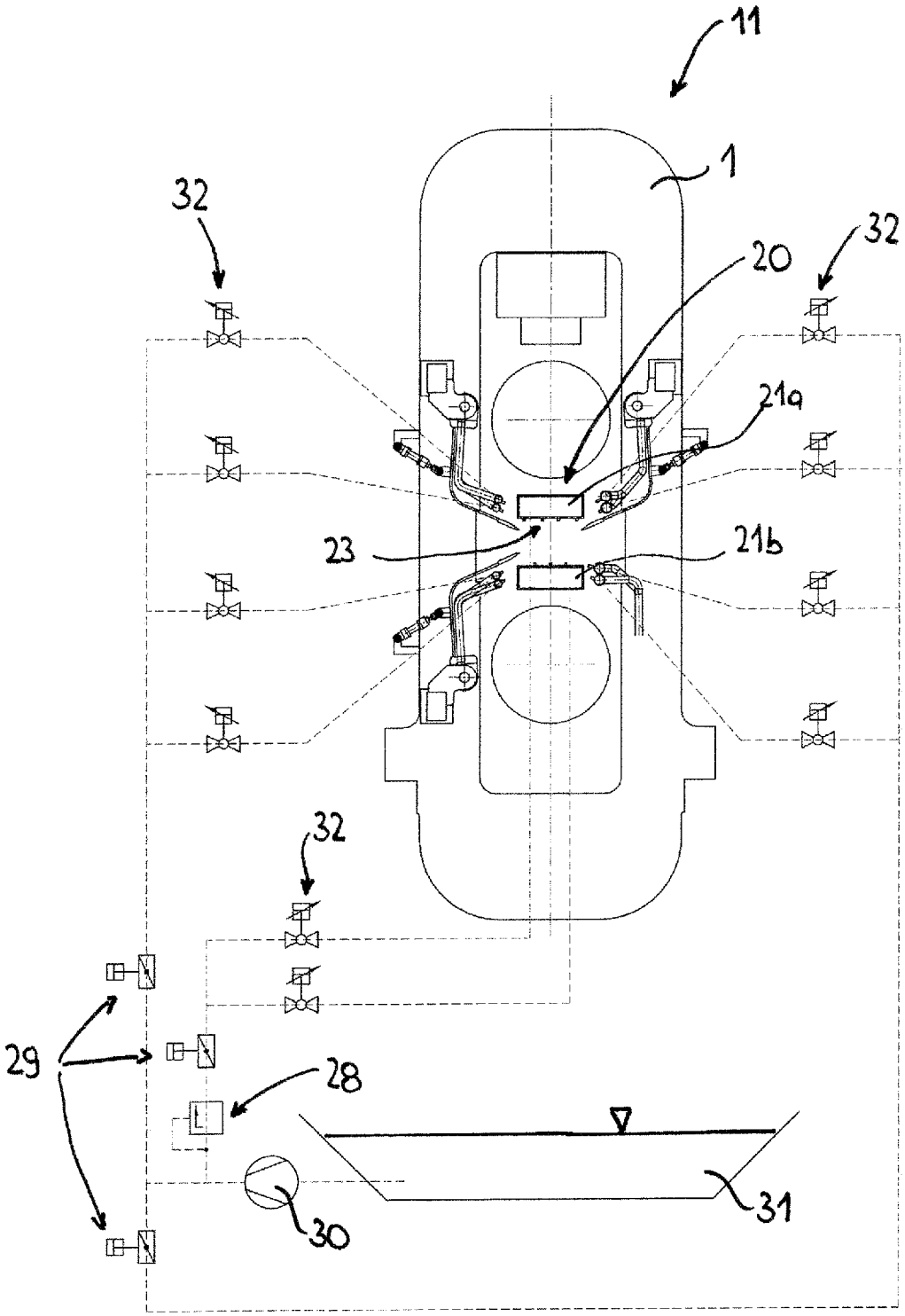
FIG. 10 shows a schematic illustration of the hydraulic management for a roll stand having an installed stand cooler.

An example of a plan of water lines for supplying a roll stand having an installed stand cooler 20 with coolant is illustrated in FIG. 10. A pump 30 fed from a tank 31 represents the coolant supply. The pressure of the cooling medium water is reduced from 13 bar to 4 bar by the pressure regulator valve 28. After the water passes the opened switch valve 29 and the flow regulator valves 32, the cooling medium, is fed by connectors to the upper and lower water tanks 21*a*, 21*b*. The upper and the lower sides of a hot strip (not illustrated here) are cooled by coolant from the cooling nozzles 23. The switch valves 29 for supplying the cooling medium to the cooling heads for the working roller cooling are closed in the installed state of the stand cooler 20 in the roll stand 11. For better use of energy, it would be more favorable for the stand coolers 20 to be fed by a separate cooling circuit without any pressure reduction caused by pressure regulator valves 28, and instead for example, to be directly fed at a pressure between 0.1 to 5 bar. These are typical pressures of existing low-pressure cooling systems. Alternatively, it would be possible for the stand cooler 20 to be connected directly to the existing coolant supply of the roll stand, without any pressure reduction.

Figure 11:
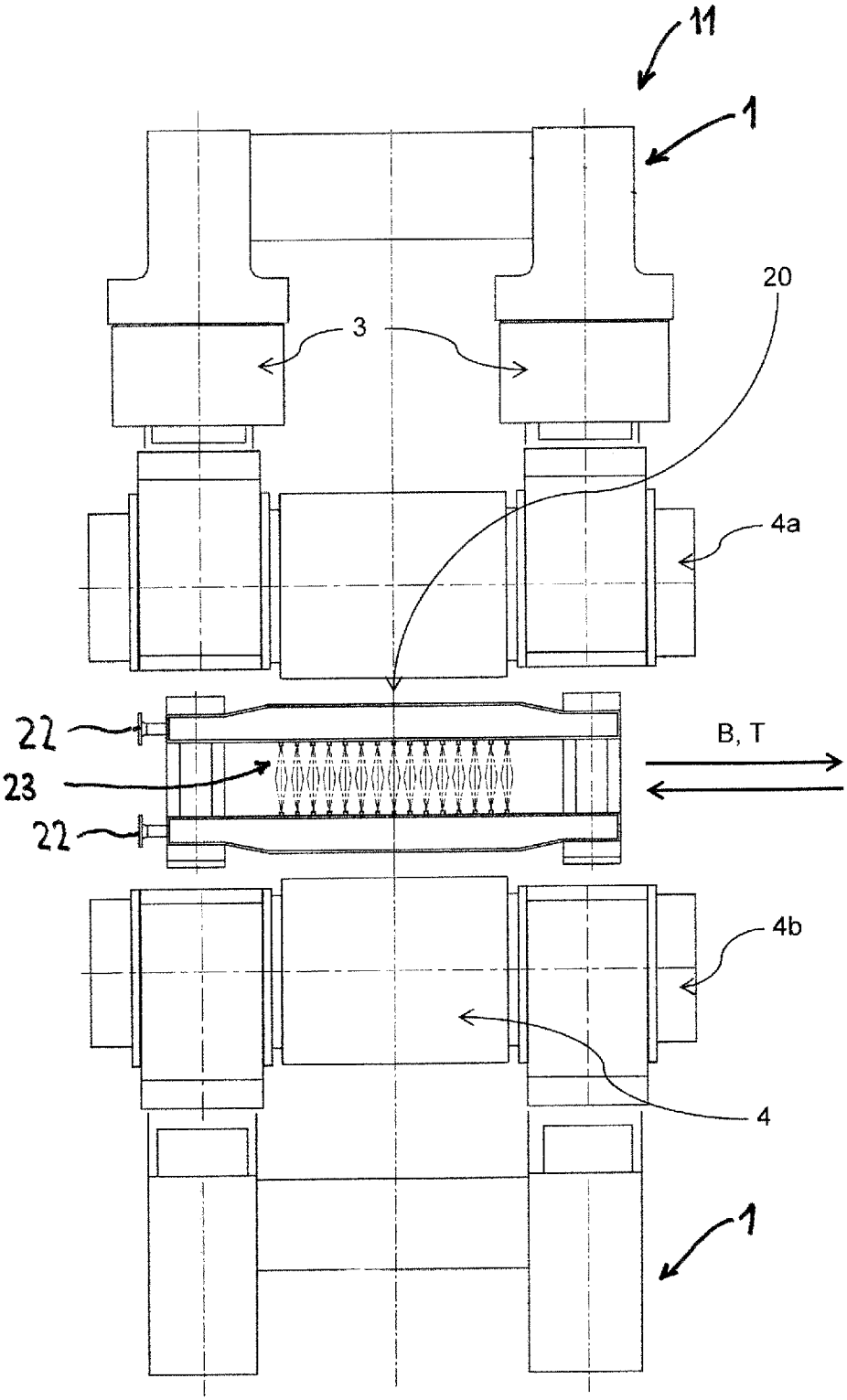
FIG. 11 shows a section in the width direction through a roll stand having an installed stand cooler.

Installation of a stand cooler 20 in the roller housings 1 or a roll stand 11 is schematically illustrated in FIG. 11. After the AGC cylinders 3 and the chocks 4*a* for the upper supporting roller 4 have been raised, the chocks 5*a*, 5*b* for the working rollers 5 as well as the working rollers 5 are removed. The stand cooler 20 is subsequently pushed-fitted horizontally in the width or transverse direction B of the roll stand 11 through the operator-side roller housing 1 (illustrated on the right here). The connectors 22 of the stand cooler 20 are finally connected to a coolant supply such that an upper and a lower side of a hot strip (not illustrated) are cooled by the cooling nozzles 23.

Figure 12:
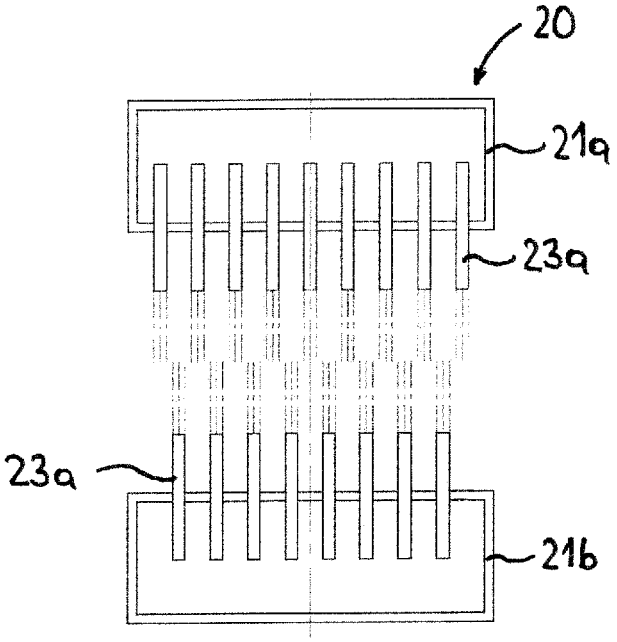
FIG. 12 shows a view of a stand cooler having cooling pipes instead of cooling nozzles.

FIG. 12 shows a schematic section through a stand cooler 20 having cooling pipes 23*a* instead of cooling nozzles 23 (see FIG. 6B). Cooling pipes 23*a* are typically operated at a positive pressure between 0.1 and 1 bar, such that said cooling pipes 23*a* can implement so-called laminar cooling in a simple manner.

The uninstalling of a stand cooler 20 from a roller housing 1 is not separately illustrated since the steps for the installation are simply carried out in the reverse order.

Figure 13:
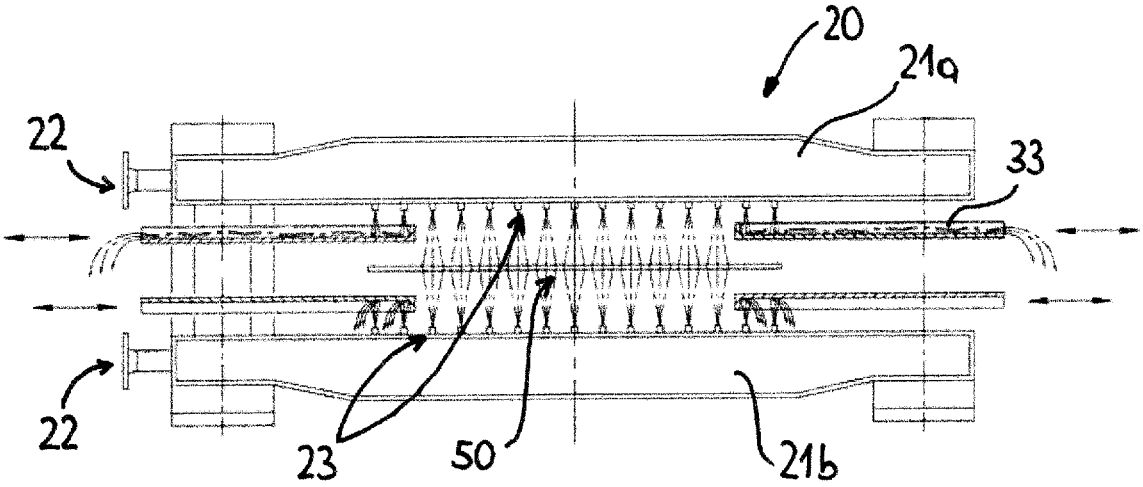
FIG. 13 shows a front view of a stand cooler having an installed stand cooler and baffle plates.

Masking of the edge regions (edge-masking) of a steel strip 50 is shown in FIG. 13. At least one edge region of the steel strip 50 herein, four edge regions in the figure, is masked by sliding in a baffle plate 33 or a channel between the cooling nozzles 23, the cooling pipes 23*a*, (see FIG. 12) or the cooling slot 24 (see FIG. 9*b*), respectively, of the stand cooler 20 and the surface of the steel strip 50 such that edge region of the strip is not there cooled. The cooling water of the cooling nozzles 23, or cooling pipes, respectively, is discharged outward in the width direction of the steel strip 50. The position of the baffle plate 33 or of the channel can be finely set manually or automatically (for example by an actuator not illustrated which displaces the baffle plate 33 in the direction of the arrow) such that excessive cooling of the edge regions is reliably prevented.

Figure 14:
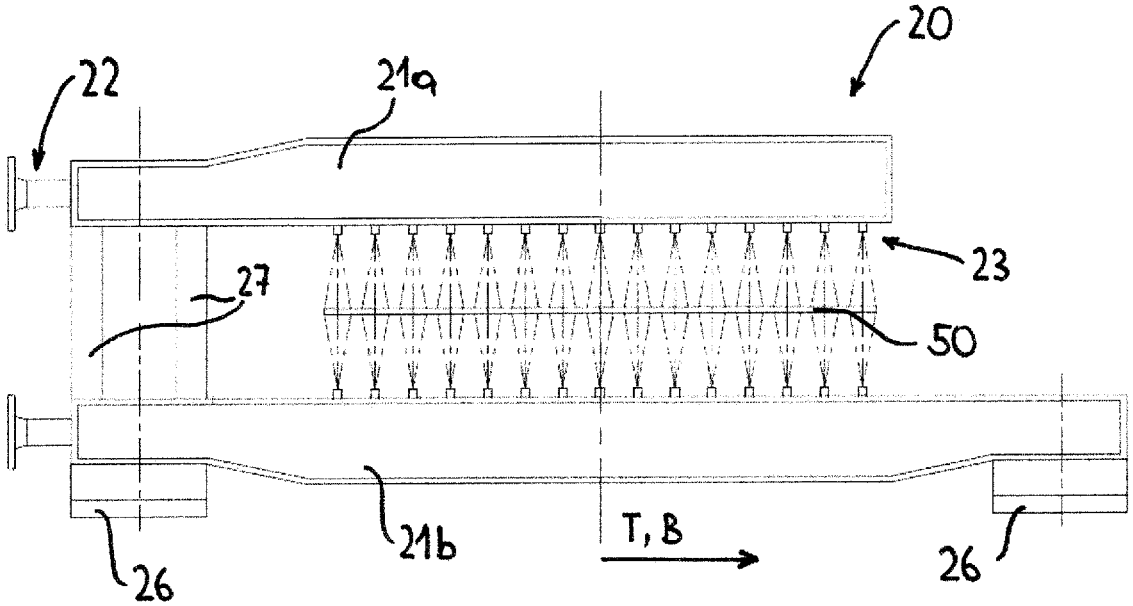
FIG. 14 shows a view of a one-piece stand cooler in a C-shape.

A stand cooler 20 in a C-shape as an alternative to the stand cooler in FIG. 7 is shown in FIG. 14. Since the C-shaped stand cooler 20 in the width direction B is open at one end, the stand cooler 20 can be installed in a roll stand and uninstalled again therefrom in a simple manner during the ongoing operation of the rolling mill. The connectors 22 of the upper and the lower water tank 21*a*, 21*b*, the cooling nozzles 23, as well as the guide faces 26 are identical to those of FIG. 7. As an alternative to the guide faces, the stand cooler 20 could also have wheels for guiding on a rail. The uprights are disposed on only one end of the stand cooler, for example the operator-side end.

While the invention has been illustrated and described in more detail by way of the preferred exemplary embodiments, the invention is not limited to the disclosed examples, and other variants can be derived therefrom by the person skilled in the art without departing from the scope of protection of the invention.

LIST OF REFERENCE SIGNS

1 Roller housing
2 Housing window
3 AGC cylinder
4 Supporting roller
4*a* Chock for the upper supporting roller
4*b* Chock for the lower supporting roller
5 Working roller
5*a* Chock for the upper working roller
5*b* Chock for the lower working roller
6 Bending block
7*a* Upper cooling head of the intermediate stand cooling
7*b* Lower cooling head of the intermediate stand cooling
8*a* Upper cooling head of the working roller cooling
8*b* Lower cooling head of the working roller cooling
9 Loop lifter roll
10 Rolling table
11 Roll stand
12 Roller table
13 Cooling manifold of a cooling section
20 Stand cooler
21*a* Upper water tank
21*b* Lower water tank
22 Connector
23 Cooling nozzle
23*a* Cooling pipe
24 Cooling slot
25 Support lugs
26 Guide face
27 Upright
28 Pressure regulator valve
29 Switch valve
30 Pump
31 Tank
32 Flow regulator valve
33 Baffle plate
40 Rolling train
45 Cooling section
50 Steel strip
B Width direction of the roller housing
C Cooled region
LC Cooled region of the cooling section
NC Non-cooled region
T Depth direction of the stand cooler
TR Transportation direction of the steel strip

The invention claimed is:

1. A method for installing a stand cooler for cooling a steel strip in a roll stand of a rolling train, wherein the stand cooler comprises a coolant supply comprising a lower coolant tank and an upper coolant tank, each coolant tank having one connector for a coolant, and having a coolant outlet positioned in the depth direction of the stand cooler, the coolant outlet comprising a plurality of cooling nozzles or cooling pipes or at least one cooling slot;

the method comprising:

removing chocks for rollers from the roll stand and removing an upper and a lower working roller from the roll stand;

installing the stand cooler in the roll stand, wherein the stand cooler is incorporated horizontally through an operator side roller housing in the width direction of the roll stand; and connecting the connectors of the upper and the lower coolant tanks to the coolant supply configured to cool the upper and the lower sides of the steel strip, the coolant provided via the coolant outlet of the lower coolant tank and of the upper coolant tank.

2. The method as claimed in claim 1, further comprising performing the installation of the stand cooler during ongoing operation of the rolling train or during an interruption in the operation of the rolling train.

3. The method as claimed in claim 1, wherein the coolant is supplied at at least one connector at a pressure of 2 to 5 bar.

4. The method as claimed in claim 1, wherein the coolant is supplied at at least one connector at a pressure of 0.1 to 1 bar.

5. A method for rolling steel strips in a hot-rolling train which has a plurality of roll stands, the method comprising:

hot-rolling a first steel strip in at least two roll stands of the rolling train in series;

cooling the first steel strip in a cooling section;

then conveying away the cooled first steel strip;

installing a stand cooler according to the method as claimed in claim 1;

hot-rolling a second steel strip in at least one roll stand of the rolling train;

cooling the second steel strip in at least one roll stand of the rolling train by operation of the stand cooler;

cooling the cooled second steel strip in the cooling section; and conveying away the cooled second steel strip.

6. A method for uninstalling a stand cooler for cooling a steel strip from a roll stand of a rolling train, wherein the stand cooler comprises a lower coolant tank and an upper coolant tank, wherein the lower coolant tank and the upper coolant tank each have one connector for receiving a coolant and a coolant outlet positioned in a depth direction of the stand cooler, the coolant outlet comprising a plurality of cooling nozzles or cooling pipes or at least one cooling slot, the method comprising:

separating the connectors of the upper and the lower coolant tank from a respective coolant supply;

uninstalling the stand cooler from the roll stand, by extracting the stand cooler in the width direction (B) of the roll stand horizontally from an operator-side roller housing; and then installing chocks and an upper and a lower working roller in the roll stand.

7. The method as claimed in claim 6, further comprising uninstalling the stand cooler during ongoing operation of the rolling train or during an interruption in the operation of the rolling train.

8. The method as claimed in claim 1, wherein the coolant is water.

9. The method as claimed in claim 5, wherein the coolant is water.

10. The method as claimed in claim 6, wherein the coolant is water.

* * * * *